US005701870A

United States Patent [19]

Gottshall et al.

[11] Patent Number: 5,701,870

[45] Date of Patent: Dec. 30, 1997

[54] PROGRAMMABLE FUEL INJECTOR CURRENT WAVEFORM CONTROL AND METHOD OF OPERATING SAME

[75] Inventors: Paul C. Gottshall, Washington; Paul M. Young, Peoria, both of Ill.

[73] Assignee: Caterpillar Inc., Peoria, Ill.

[21] Appl. No.: 632,046

[22] Filed: Apr. 15, 1996

[51] Int. Cl.[6] ..... H01H 47/32; F02D 41/30

[52] U.S. Cl. ..... 123/490; 361/154

[58] Field of Search ..... 123/490; 361/152, 361/153, 154

[56] References Cited

U.S. PATENT DOCUMENTS

| | | | |
|---|---|---|---|
| 4,238,813 | 12/1980 | Carp et al. | 123/490 |
| 4,479,161 | 10/1984 | Henrich et al. | 361/154 |
| 4,604,675 | 8/1986 | Pfederer | 123/490 |
| 4,680,667 | 7/1987 | Petrie | 123/490 |
| 4,922,878 | 5/1990 | Shinogle et al. | 123/490 |
| 4,980,793 | 12/1990 | Glowczewski et al. | 123/490 |

FOREIGN PATENT DOCUMENTS 0548915A 6/1993 European Pat. Off. .

*Primary Examiner*—Willis R. Wolfe
*Attorney, Agent, or Firm*—R. Carl Wilbur

[57] ABSTRACT

A fuel injector control circuit is disclosed. The circuits can be used with a plurality of different fuel injectors and can be programmed to produce a plurality of different injector current waveforms. The control preferably includes a microprocessor with memory connected to a multiplexer and an application specific integrated circuit. The control can also be used to increase the current rise time of a specific injector current waveform.

2 Claims, 4 Drawing Sheets

PROGRAMMABLE FUEL INJECTOR CURRENT WAVEFORM CONTROL AND METHOD OF OPERATING SAME

TECHNICAL FIELD OF THE INVENTION

The present invention relates generally to electronic controls for use with compression ignition engines, and more particularly to electronic controls used with fuel injectors on compression ignition engines.

BACKGROUND OF THE INVENTION

Fuel injectors are well known in the art and provide a way to introduce fuel into the cylinders of an engine. Fuel injectors often provide more flexibility in terms of timing and other performance considerations than a carburetor or other means for introducing fuel into the cylinders. Typically, fuel injectors include an actuating solenoid that opens the fuel injector nozzle when the solenoid is energized. Fuel is then typically injected into the engine cylinder as a function of the time period during which the solenoid remains energized. Fuel flow is typically terminated when the solenoid is no longer energized. An example of the type of fuel injector described above is disclosed in U.S. Pat. No. 5,176,115.

Accurate control of both the timing and quantity of fuel injected is important to engine performance and emissions. To accurately control fuel injection, it is important to know the relationship between the time when electrical current is applied to the fuel injector solenoid and the time when fuel begins to be injected. Likewise the relationship between terminating the electrical current to the solenoid and the time when fuel flow to the cylinder is terminated must be known. Those relationships, and the specific current waveforms that most accurately control the opening and closing of the fuel injector vary from one model or type of fuel injector to another. For example, one type of fuel injector may be most accurately controlled with a current waveform of the general shape shown in FIG. 2 of the present application, while a second type of injector may be more accurately controlled with a current waveform of the general shape shown in FIG. 3 of the present application.

In prior art current waveform controls, a specific control circuit is designed for each specific desired current waveform. Thus, if an engine manufacturer uses several different fuel injectors across its product line, the manufacturer typically is required to have a specific current waveform control circuit for each fuel injector. This results in the additional expense of having to design several current waveform control circuits, the expense of having to inventory separate parts for each circuit, and the expense of having to maintain an inventory of all the different circuit boards. It would be preferable to have a single, generic current waveform control circuit that could produce all of the different desired current waveforms. Then, the generic current waveform control circuit could be used with all of the desired fuel injectors.

A further drawback with previously known current waveform control circuits is that they utilize discrete circuit components. In circuits with discrete components, the rise time of the electrical current through the injector solenoid is determined by the inherent resistance-inductance-capacitance ("RLC") characteristic of the fuel injector solenoid and control circuit. It is therefore not possible to vary or otherwise alter the current rise time in the fuel injector solenoid. It would be preferable to have a control circuit in which the current rise time could be modified from the rise time determined by the RLC constants.

The present invention is directed toward overcoming one or more of these drawbacks associated with the waveform control circuits of the prior art.

SUMMARY OF THE INVENTION

The present invention is directed toward a programmable control circuit for applying electrical current to a fuel injector. The invention includes an electronic controller that produces a desired current waveform parameter and a control signal. The control circuit is connected to the electronic controller and receives the desired current waveform parameter and the control signal. The control circuit is capable of producing a plurality of injector current waveforms. However, the control circuit produces one of said plurality in response to the desired current waveform parameter and the control signal. In this manner, the present invention can be used with a plurality of different fuel injectors.

These and other aspects and advantages of the present invention will become apparent upon reading the detailed description of the preferred embodiment in connection with the drawings and appended claims.

DETAILED DESCRIPTION OF A PREFERRED EMBODIMENT OF THE INVENTION

Figure 1:
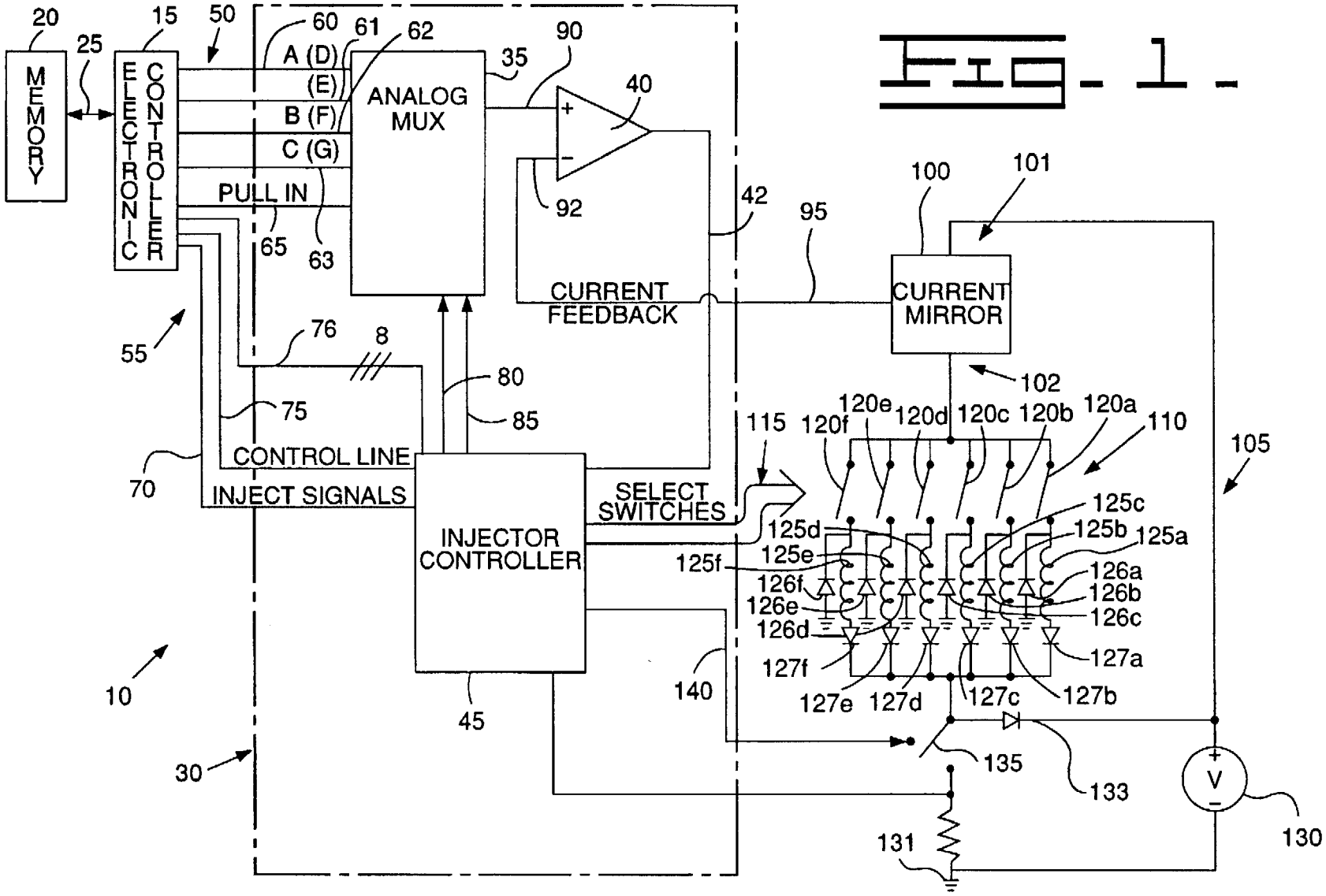
FIG. 1 is a block diagram of the control circuit of a preferred embodiment of the present invention.

Referring first to FIG. 1, a block diagram of a preferred embodiment of the programmable fuel injector current waveform control 10 is shown. Preferably the control 10 includes an electronic controller 15. Associated with the electronic controller 15 is a memory device 20. As is known in the art, the electronic controller 15 and the memory 20 are generally connected by an address bus and a data bus, among others, which are generally represented in FIG. 1 by connection 25. As is known to those skilled in the art, the memory 20 generally includes both software instructions and data storage. Although FIG. 1 discloses a discrete memory device 20, separate from the electronic controller 15, other devices are known in the art which include an electronic controller 15 and memory 20 within a single device. The present invention is not limited to the use of an electronic controller 15 and discrete memory device 20, but instead includes all other electronic controller 15 and memory 20 combinations as may fall within the spirit and scope of the present invention as defined by the appended claims.

The electronic controller 15 used in a preferred embodiment of the present invention is a Motorola 68300 family microprocessor, manufactured by Motorola Semiconductor Products, Inc. located in Phoenix, Ariz. However, other suitable microprocessors known in the art can be readily and easily substituted without deviating from the spirit and scope of the present invention.

In a preferred embodiment, the electronic controller 15 is connected to control circuitry 30. The control circuitry preferably includes an analog multiplexer 35, a comparator 40, and an injector controller 45. The control circuit 30 receives a plurality of desired current waveform parameters 50 and a plurality of control signals 55.

Figure 2:
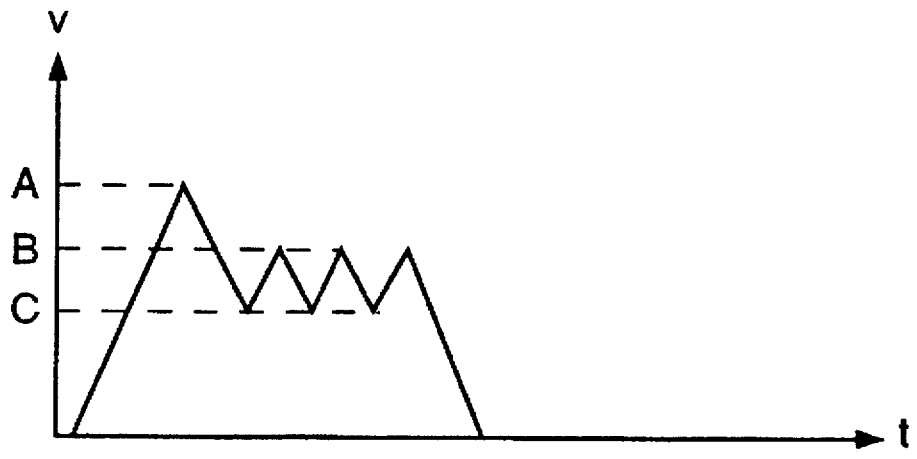
FIG. 2 shows an exemplary current waveform for controlling a fuel injector.
Figure 3:
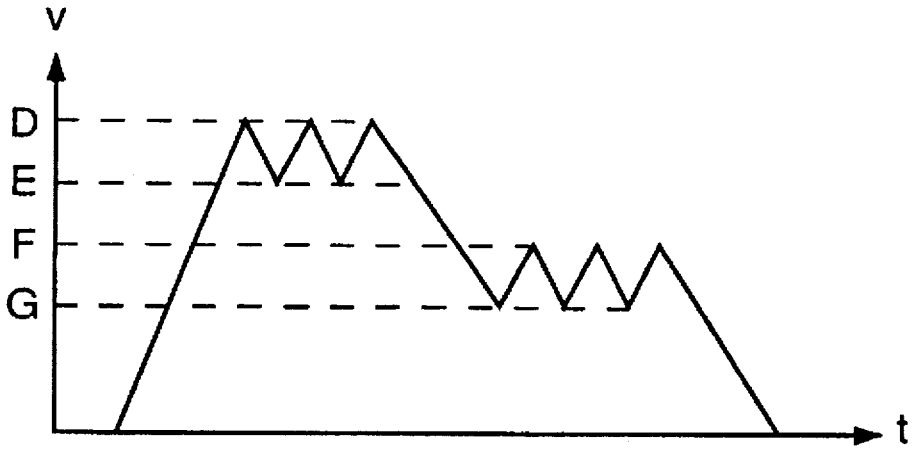
FIG. 3 shows an exemplary current waveform for a fuel injector.

In a preferred embodiment, the electronic controller 15 produces four desired current waveform parameters 60, 61, 62, and 63 which are inputs to the analog multiplexer 35. These desired current waveform parameters 60, 61, 62, and 63 are preferably produced by the electronic controller 15 in a pulse width modulated waveform. The pulse width modulated waveform is filtered to produce an analog signal between 0 and five volts. Such filtering is well known in the art and is therefore neither depicted in FIG. 1 nor discussed herein. Those skilled in the art can readily and easily incorporate a filter in the output of the electronic controller 15 to produce such analog signals. Also connected to the analog multiplexer 35 is a pull-in signal 65, produced by the electronic controller 15. The pull-in signal 65 and its function in the control circuit 30 of a preferred embodiment of the present invention, is described in more detail below with reference to FIGS. 2–4.

In a preferred embodiment of the present invention, the electronic controller 15 produces an injection signal 70, control line 75, and data lines 76 which are inputs to the injector controller 45. Although the data lines 76 are shown physically connected between the electronic controller 15 and the injector controller 45, it will be recognized by those skilled in the art that these connections, as well as the data and control connections between the electronic controller 15 and the memory 20 and the analog multiplexer 35, are determined by the outputs and architecture of electronic controller 15. Typically, those data and control connections would be over a data bus and the flow of information would be controlled, in part, by an address bus (not shown) that is connected between the different circuit components. Transferring data between components using a data and an address bus is well known in the art and is not described herein. FIG. 1 shows a simplified view of the necessary connections for clarity. The injection signal 70, control line 75, and data lines 76 are described in more detail below with reference to FIGS. 2–5.

The injector controller 45 produces multiplexer control lines 80, 85 which are received by the analog multiplexer 35. As is described more fully below, the injector controller 45 produces signals on the multiplexer control lines 80, 85 that determine which of the desired current waveform parameters 60, 61, 62, and 63 appear at the output 90 of the analog multiplexer 35. Thus, as is known to those skilled in the art, by varying the multiplexer control lines 80, 85 the injector controller 45 dictates which of the desired current waveform parameters 60, 61, 62, 63 is passed through the analog multiplexer 35 to the output 90.

The output 90 of the analog multiplexer 35 is connected to a positive input of a comparator 40. The negative input 92 of the comparator 40 is connected to a current feedback signal 95 produced by a current mirror circuit 100. Current mirrors, such as the one used in an embodiment of the present invention, are well known in the art. The current mirror 100 produces a current feedback signal 95 as a function of the current flowing through the current mirror 100 from the current mirror input 101 to the current mirror output 102. Any known current mirror could be readily and easily implemented in connection with the present invention by one skilled in the art.

The current mirror 100 is connected in series with fuel injector solenoids 105 and switching circuitry 110. Although FIG. 1 illustrates six fuel injector solenoids **125*a–f***, the present invention is not limited to a six cylinder engine having six fuel injectors. In contrast the present invention may control a greater or fewer number of fuel injectors and engine cylinders.

The switching circuit 110 is connected to the injector controller 45 through a set of select switch lines 115. The injector controller 45 controls the opening and closing of individual switches **120*a–f* in the switch circuit 110 by manipulating the outputs on the select switch lines 115. For example, if the injector controller 45 closes a switch 120*f*, then the positive terminal of the voltage source 130 is connected to the corresponding fuel injector solenoid 125*f*. Then, when the injector controller 45 applies a control signal on line 140 to an injector control switch 135 thereby closing the switch, the voltage V at the power supply 130 is applied across the fuel injector solenoid 125*f* thereby energizing the solenoid 125*f*. In a similar manner each of the other switches 120*a–f* of the switch circuit 110 can be closed to cause current to be applied to a corresponding fuel injector solenoid 125*a–f*. The injector controller 45 controls which one of the switches in the switching circuit 110 is closed at a given time. In this manner the injector controller 45 controls which fuel injector is enabled, and the injector control switch 135** determines the time when the enabled fuel injector is energized.

The injection timing strategies for opening and closing the individual switches in the switch circuit 110 and for applying the injector control signal 140 are developed for and are generally unique to the specific engine that is to be controlled. Timing strategies are well known in the art. One skilled in the art could readily and easily develop an appropriate timing strategy for use with a particular desired engine.

Diodes **126*a–f* are connected between the positive terminal of the fuel injector solenoids 125*a–f* and ground. Additional diodes 127*a–f* are connected in series with the fuel injector solenoids 125*a–f*. As is known to those skilled in the art, the inductance of a fuel injector solenoid 125*a–f* creates a large back EMF when current flow through the solenoid 125*a–f* is abruptly terminated. The diodes 126*a–f* and 127*a–f* protect the fuel injector solenoids 125*a–f* from the high voltage developed by the back EMF. Preferably, electrical current to a specific fuel injector solenoid 125*a–f* is terminated by opening both the corresponding switch 120*a–f* and the injector control switch 135 at approximately the same time. By doing so, current flow through the fuel injector solenoid 125*a–f* decays more quickly than if only the injector control switch 135 were opened. When both the fuel injector solenoid 125*a–f* and the injector control switch 135 are opened, the back EMF generates a current that flows through the solenoid 125, the diode 127, a second diode 133 and the power supply 130 to ground 131**.

An alternative embodiment might only open the injector control switch 135. The alternative embodiment would permit the current flow through the injector solenoid to decay more slowly, making it more difficult to control the termination of fuel to the engine cylinder, among other things. As shown in FIG. 1, in the alternative embodiment, when the injector control switch 135 is opened, the back EMF causes current to continue flowing through the solenoid 125, the diode 127, a second diode 133, through the current mirror 101, and the switch 120. In this manner, the current flowing through a fuel injector solenoid 125 will decay at a rate determined by the RLC constants of the circuit, once the injector control switch 135 is opened.

Figure 4:
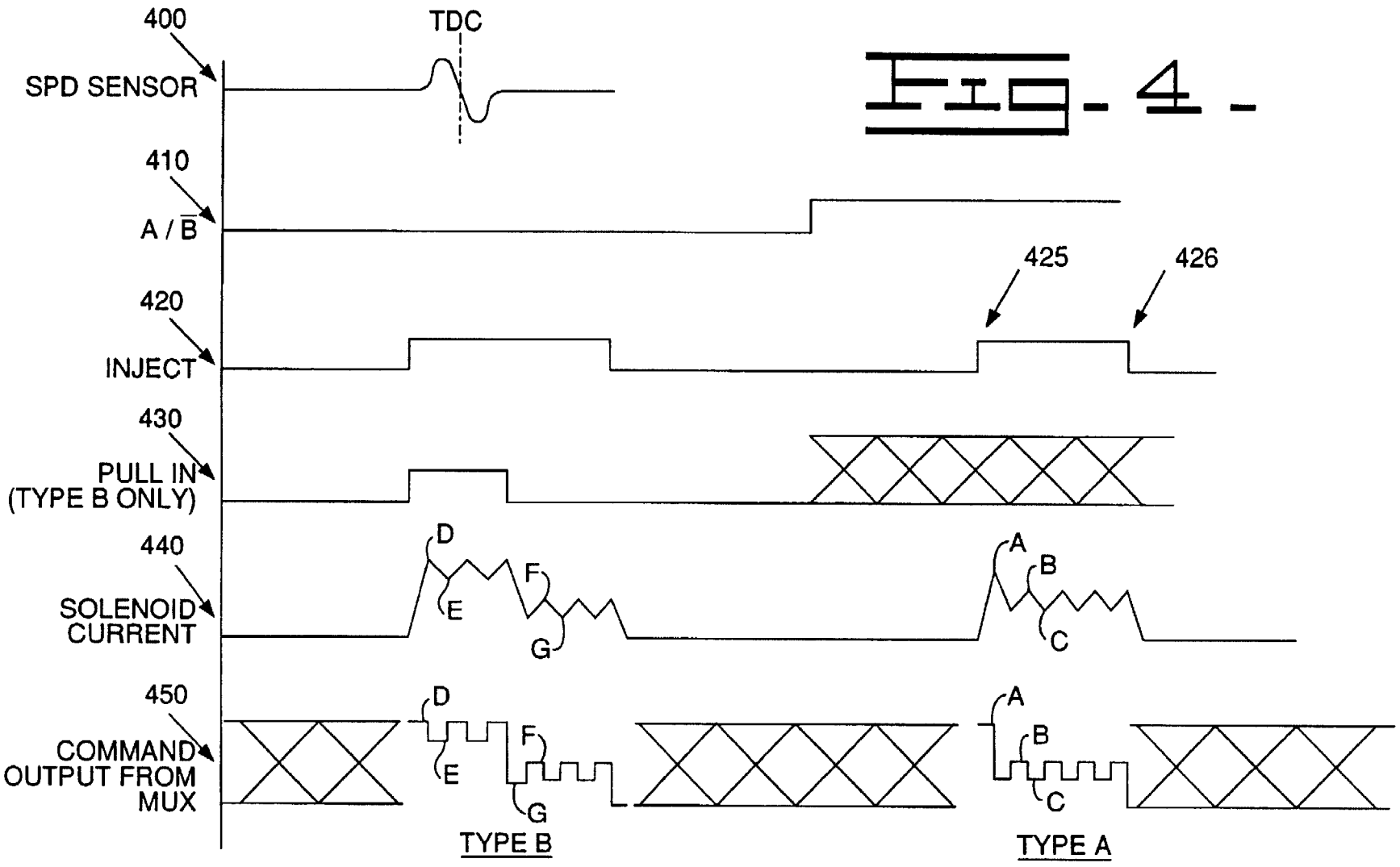
FIG. 4 shows a timing diagram of the relationship between various control signals in an embodiment of the present invention.

Referring now to FIG. 4, a timing diagram of the signals of the waveform control 10 and in particular the control circuitry 30 and the injector controller 45 is shown. As shown in FIG. 4 the first signal 400 represents the output of a speed sensor (not shown in FIG. 1) Connected to the engine, which produces a signal that permits the electronic controller 15 to determine top dead center of piston travel in a specific cylinder. As is known to those skilled in the art, the timing of fuel injection is generally referenced to the top dead center position of the piston. The inclusion of the speed sensor signal 400 in the timing diagram of FIG. 4 is for illustration only, and is used to show that the other signals are referenced to the speed sensor signal 400. FIG. 4 does not show a specific timing relationship between the speed sensor signal and the other signals.

Signal 410 is generated by the electronic controller 15 on the control line 75 issued to the injector controller 45. The control signal $A/\overline{B}$ determines which of two fuel injector signals will be issued by the control circuitry 30. For example, as shown in FIG. 4, if the programmable injector current waveform control 10 is to develop a current waveform for a type "A" fuel injector then the signal generated by the electronic controller 15 over control line 75 is a logic level high. In contrast, if the current waveform to be generated is for a type "B" fuel injector then the signal generated by the electronic controller 15 over control line 75 is a logic level low. As shown in FIG. 4, the programmable injector current waveform control 10 will generate a current waveform for a fuel type "B" injector until the $A/\overline{B}$ signal transitions from a logic level low to a logic level high. When the signal 410 is a logic level high, the programmable current waveform control 10 develops current waveform signals for a type "A" fuel injector.

An inject signal 420 and a pull-in signal 430 are generated by the electronic controller 15. The inject signal 420 is issued by the electronic controller 15 on the inject signal line 70 received by the injector controller 45. The rising edge of the inject signal determines the time at which the injector controller 45 issues a signal over line 140 to close the injector control switch 135 thereby permitting current to flow through a fuel injector solenoid 125*a–f* determined by the switching circuit 110. In this manner, when the inject signal 420 transitions from a logic level low to a logic level high, current begins flowing through a fuel injector solenoid 125*a–f*. When the inject signal 420 transitions from high to low, the injector controller 45 issues a signal over line 140 to open the injector control switch 135 thereby disconnecting the voltage source 130 from the injector solenoid 125. At the same time, the injector controller 45 opens the respective switch 120, thereby causing current to decay through the diodes and return to zero.

Solenoid current 440 is also shown in FIG. 4. The transition of the inject signal 420 from a logic level low to a logic level high corresponds to the initial rise of the solenoid current 440 from zero up to a current level D. Likewise, the transition of the inject signal 420 from a logic level high to a logic level low corresponds to the time at which the solenoid current signal begins to decay to zero.

The second transition from a logic level low to a logic level high of the inject signal 420 illustrates the signal generated by the programmable injector current waveform control 10 for a type "A" fuel injector. Then, when the inject signal 420 issued by the electronic controller 15 over the inject signal line 70 transitions from a logic level low to a logic level high 425 the injector controller 45 issues a signal over line 140 to cause the injector control switch 135 to close thereby energizing the fuel injector solenoid 125. As shown in FIG. 4, the solenoid current 440 begins to rise from zero to a current level A. When the inject signal 420 transitions from a logic level high to a logic level low 426 the injector controller 45 issues a signal over line 140 causing the injector control switch 135 to open thereby disconnecting the voltage source 130 from the fuel injector solenoid 125. At the same time, the injector controller 45 also opens the respective switch 120, and in this manner, the solenoid current 440 begins to decay to zero. Thus, the duration of the fuel injection signal in both the type "A" and type "B" fuel injectors is a function of the length of the inject signal 420.

In a preferred embodiment of the present invention, a type "B" injector requires a pull-in period during which higher current levels are applied. Those higher current levels cause the injector to open more quickly and thereby decrease the delay between applying current to the fuel injector solenoid and the time at which fuel is actually injected into the engine cylinder. Thus, as shown in FIG. 4, the solenoid current 440 initially rises to a current level D and subsequently dithers between current levels D and E. Once the fuel injector is open, the elevated current levels D and E are greater than is required to keep the fuel injector in an open position. The current levels are decreased to a hold-in current designated by current levels G and F. During this hold-in period, the current levels dither between G and F. To designate the duration of the pull-in period, the electronic controller 15 issues a pull-in signal 430 over the pull-in line 65 to the analog multiplexer 35. As shown in FIG. 4, the transition from a logic level low to a logic level high generally coincides with the transition of the inject signal 420 from a logic level low to a logic level high. Then, when the pull-in signal 430 transitions from a logic level high to a logic level low, the solenoid current 440 transitions from the higher pull-in current levels D,E to the lower hold-in current levels F,G. In this manner, the pull-in signal 430 determines the duration of the pull-in portion of the solenoid current signal 440. As shown in FIG. 4, there is no pull-in signal required for a type "A" injector.

The command output signal 450 from the analog multiplexer 35 appears on line 90 as a positive input to the comparator 40. As shown in FIG. 4, for a type B injector the voltage levels appearing on the output 90 vary between voltage levels D,E,F,G (corresponding to desired current levels D,E,F,G) appearing at the inputs 60, 61, 62, 63 of the analog multiplexer 35. The injector controller 45 controls which voltage level D,E,F,G appears at the output 90 by manipulating the multiplexer control lines 80, 85. As shown in FIG. 1, the current mirror 100 produces a voltage on line 95 that is a function of current flowing through a fuel injector solenoid 125*a–f*. When the electronic controller 15 first causes the inject signal to transition from a low to a high thereby causing digital injector controller 45 to issue a signal on line 140 closing the injector control switch 135, current begins to flow through an injector solenoid 125*a–f*. As noted above, the specific injector is determined by the switching circuit 110. As the current level flowing through the injector solenoid 125 increases, the voltage of the current feedback signal 95 increases. Once the voltage of the current feedback signal 95 exceeds the voltage level on line 90, the output 42 of the comparator 40 transitions from a logic level high to a logic level low. On that transition, the injector controller 45 manipulates the multiplexer control lines 80,85 thereby causing the analog multiplexer 35 to pass the voltage level E through to output 90. The injector controller 45 also issues a signal on line 140 causing the injector control switch 135 to open. Current flowing through the fuel injector solenoid 125 then begins to decay, as described above. As the current decays the voltage produced by the current mirror 100 on line 95 decreases. When the current feedback voltage level on line 95 falls below the voltage level E on line 90, the output 42 of the comparator 40 transitions from a logic level low to a logic level high. In response, the injector controller 45 manipulates the multiplexer control line 80, 85 thereby causing the analog multiplexer 35 to pass voltage level D to the output 90. At the same time, the injector controller 45 issues a control signal on line 140 causing the injector control switch 135 and also issues a signal on the select switch lines 115 causing the respective switch 120*a–f* to close. Current again begins to flow through the injector solenoid 125. As the current flow increases, the current feedback signal voltage on line 95 produced by the current mirror 100 increases. When the voltage level on line 95 increases above the voltage level D on line 90 then the output 42 of the comparator 40 transitions from a logic level high to a logic level low. The injector controller 45 then manipulates the multiplexer control lines 80,85 to cause the analog multiplexer 35 to pass voltage level E to the output 90. This series of transitions from voltage level D to voltage level E at the output 90 of the analog multiplexer 35 is generally shown in FIG. 4. The injector controller 45 causes the output 90 of the analog multiplexer 35 to alternate between voltage levels D and E until such time as the pull-in signal 430, issued by the electronic controller 15 to the analog multiplexer 35 on the pull-in line 65, transitions from a logic level high to a logic level low.

When the pull-in signal 430 transitions from a logic level high to a logic level low the injector controller 45 manipulates the multiplexer control lines 80, 85 to cause the analog multiplexer 35 to pass voltage level G to the output 90. As shown in FIG. 4, the injector controller 45 then issues a signal on line 140 causing the injector control switch 135 and also issues a signal on the select switch lines 115 causing the respective switch 120*a–f* to open. Current flowing through the fuel injector solenoid 125 then decays and the current mirror 100 produces a decreasing current feedback voltage on line 95. When the current feedback voltage on line 95 falls below voltage level G on line 90, the output 42 of the comparator 40 transitions from a logic low to a logic level high. This causes the injector controller manipulate the multiplexer control lines 80, 85 thereby causing the analog multiplexer 35 to pass voltage level F to the output 90. The injector controller 45 also issues a control signal on line 140 that causes the injector control switch 135 and also issues a signal on the select switch lines 115 causing the respective switch 120*a–f* to close. The voltage source 130 is then connected to the fuel injector solenoid 125 and current flow begins to increase. As the current flow increases the current mirror 100 produces a current feedback voltage 95 that is increasing. When the current feedback voltage 95 exceeds the voltage level F on line 90 the output 42 of the comparator 40 transitions from a logic level high to a logic level low.

As shown in FIG. 4 the injector controller 45 causes the output 90 from the multiplexer 35 to alternate between voltage levels F and G, and thereby causes the solenoid current 440 to alternate between corresponding current levels F and G, until such time as the inject signal 420, issued by the electronic controller on line 70, transitions from a logic level high to a logic level low. Then, the injector controller 45 issues a control signal on line 140 that causes the injector control switch 135 and also issues a signal on the select switch lines 115 causing the respective switch 120*a–f* to open. The injector controller 45 causes the control switch 135 to remain open thereby permitting current flow through the fuel injector solenoid 125 to decay to about zero. This causes the fuel injector to close and discontinues fuel injection into the engine cylinder.

The description of the functioning of the waveform control 10 for a type "A" fuel injector is similar to the above description. For a type "A" injector, when the inject signal 420 issued by the electronic controller 15 on line 70 transitions from a logic level low to a logic level high 425 the injector controller 45 manipulates the multiplexer control lines 80, 85 thereby causing the multiplexer to pass voltage level A to the output 90. The injector controller 45 also issues a signal on line 140 causing the injector control switch 135 and also issues a signal on the select switch lines 115 causing the respective switch 120*a–f* to close, which connects the power source 130 to the fuel injector solenoid 125. Current flowing through the fuel injector solenoid 125 increases and the current mirror 100 responsively produces an increasing current feedback voltage on line 95. When the voltage level on line 95 exceeds the voltage level A on line 90, the output 42 of the comparator 40 transitions from a logic level high to a logic level low. The injector controller 45 responsively manipulates the control lines 80, 85 thereby causing the analog mulitplexer 35 to pass voltage level C to the output 90. The injector controller also issues a control signal on line 140 causing the injector control switch 135 and also issues a signal on the select switch lines 115 causing the respective switch 120*a–f* to open, which disconnects the power source 130 from the injector solenoid 125. Current flow then begins to decay through the second resistor 133 and resistor 127 as described above. The current mirror responsively produces a decreasing current feedback voltage on line 95. When the current feedback voltage on line 95 decreases below the voltage level C on line 90, the output 42 of the comaprator 40 transitions from a logic level low to a logic level high.

The injector controller 45 then manipulates control lines 80, 85 causing the analog multiplexer to pass voltage level B to the output 90. The injector controller 45 also produces a control signal on line 140 causing the injector control switch 135 and also issues a signal on the select switch lines 115 causing the respective switch 120*a–f* to close, which connects the power source 130 to the fuel injector solenoid 125. Current flowing through the solenoid therefore begins to increase and the current mirror 100 responsively produces an increasing current feedback voltage on line 95. When the current feedback voltage on line 95 exceeds the voltage level B on line 90 the output 42 of the comparator 40 transitions from a logic level high to a logic level low. The injector controller 45 then manipulates the analog multiplexer control lines 80,85 causing the output 90 of the analog multiplexer 35 to transition between voltage levels B and C and the corresponding solenoid current 440 to transition between corresponding current levels B and C until such time as the inject signal 420 transitions from a logic level high to a logic level low 426.

When the inject signal transitions from a logic level high to a logic level low 426 the injector controller 45 issues a signal on line 140 causing the injector control switch 135 and also issues a signal on the select switch lines 115 causing the respective switch 120*a–f* to open. Current flowing through the fuel injector solenoid 125 then decays through the second diode 13 and the diode 127 until current flow reaches zero. This closes the fuel injector and causes fuel injection in the cylinder to be discontinued.

Although a preferred embodiment of the present invention has been described with reference to two solenoid current waveforms, the present invention could readily and easily be used to control a plurality of different types of fuel injectors.

In another aspect of a preferred embodiment of the present invention, the programmable waveform control 10 can be used to increase the current rise time in the fuel injector solenoids 125*a–f*.

Figure 5:
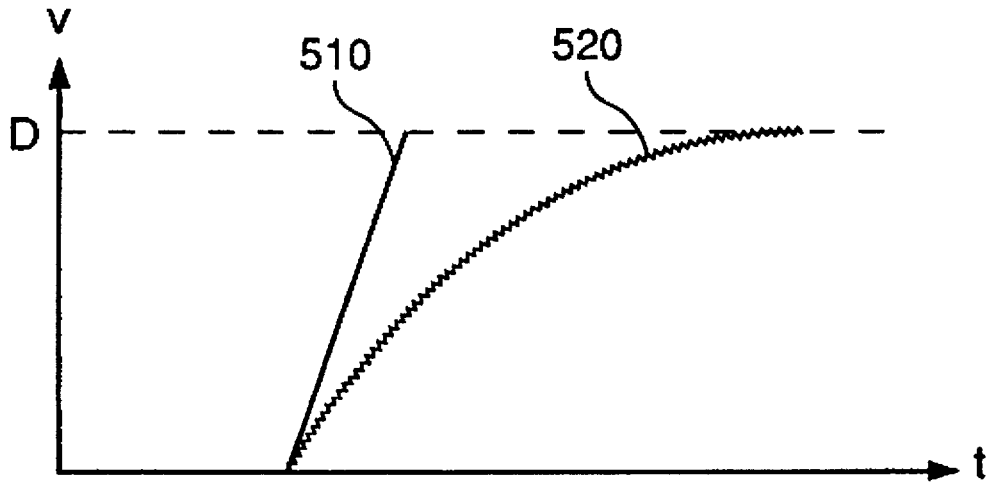
FIG. 5 shows a current rise time for an exemplary current waveform.

The increased rise time of the injector waveform is typically achieved by an embodiment of the present invent by controlling the injector control switch 135. As described above the injector controller 45 issues a signal on line 140 causing the injector control switch to open or to close. In the description above, the control switch is typically held open or kept closed until the current level through the injector solenoid 125*a–f* has reached a desired level. The rise time for the current to reach that level is a function of the RLC constant of the circuit. However, in one aspect of an embodiment of the present invention, that rise time can be increased by issuing a pulse width modulated signal on line 140 to control the injector control switch 135. The current rise time is then also a function of the duty cycle of the pulse width modulated signal. As shown in FIG. 5, a representative current rise time for a typical current waveform 510 is shown. Also shown is a current waveform 520 implementing the increased rise time aspect of an embodiment of the present invention.

As shown in FIG. 1, data lines 76 are connected between the electronic controller 15 and the injector controller 45. The data lines 76 typically include eight data bit lines, although a greater or fewer number could be readily and easily implemented, and permit eight data bits to be transferred from the electronic controller 15 to the injector controller 45. These eight bits represent a duty factor of the pulse width modulated signal that is delivered to the injector control switch 135 over line 140. Thus, for example, if the bits on the data lines represent the number 100, then the duty cycle of the pulse width modulated signal on line 140 will be 100/255. Because the injector control switch will be on for 100/255 of a cycle and off for the remaining portion of a cycle, and the power supply 130 will only be connected to the specific solenoid 125 when the switch is closed, the rise time for the current will be increased and is generally represented by waveform 520 in FIG. 5. Generating a pulse width modulated signal is well known in the art, and therefore is not described further herein.

As can be seen from FIG. 5 the above described embodiment of the present invention increase the rise time associated with a current waveform. In this manner the invention can be used in a broader range of applications, some of which might require a longer rise time than the RLC constants of the control circuit would otherwise provide. As described herein, the present invention can therefore be used in connection with a plurality of different fuel injectors or can provide a plurality of different waveforms to a single injector.

We claim:

1. An apparatus for variably controlling an injection current waveform to a fuel injector on a compression ignition engine, said apparatus comprising:

an electronic controller, said electronic controller producing at least one desired current waveform parameter and a control signal;

a memory device associated with said electronic controller;

a control circuit connected to said electronic controller and receiving said desired current waveform parameter and said control signal;

wherein said control circuit is capable of producing a plurality of injection current waveforms corresponding to a plurality of fuel injectors and control circuit produces one of said plurality of injection current waveforms responsive to said desired current waveform parameter and said control signal;

a first desired current waveform parameter;

a second desired current waveform parameter;

a multiplexer receiving said first and second desired current waveform parameters;

an application specific integrated circuit (injector controller) receiving said control signal and producing a mulitplexer control signal;

said control circuit receiving a current feedback signal corresponding to current flowing through a fuel injector; and said injector controller producing a multiplexer control signal causing said multiplexer to output said second desired current waveform parameter in response to said current feedback signal indicating a current corresponding to said first desired current waveform parameter.

2. An apparatus according to claim 1, wherein said injector controller produces fuel injector select signal to cause a desired current waveform to be applied to one of a plurality of fuel injectors.

* * * * *